US005984746A

United States Patent [19]

Rasmussen et al.

[11] Patent Number: 5,984,746

[45] Date of Patent: Nov. 16, 1999

[54] ATTACHING SPACERS IN A DISPLAY DEVICE

[75] Inventors: Robert T. Rasmussen; David A. Cathey, both of Boise, Id.

[73] Assignee: Micron Technology, Inc., Boise, Id.

[21] Appl. No.: 08/764,485

[22] Filed: Dec. 12, 1996

[51] Int. Cl.[6] ..... H01J 9/02

[52] U.S. Cl. ..... 445/24; 313/495

[58] Field of Search ..... 430/198; 445/24, 445/25; 313/495

[56] References Cited

U.S. PATENT DOCUMENTS 4,732,838 3/1988 Sechi et al. ..... 430/198
5,716,251 2/1998 Watkins ..... 445/24

*Primary Examiner*—Kenneth J. Ramsey
*Attorney, Agent, or Firm*—Hale and Dorr LLP

[57] ABSTRACT

A faceplate in a flat panel display has attachment sites made with a method that includes steps of mixing frit and photoresist to form a mixture, applying the mixture to the substrate, softbaking the substrate and mixture, and exposing and developing the resist to define adhesion sites. Spacers are then attached to the faceplate at the adhesion sites.

19 Claims, 3 Drawing Sheets

ATTACHING SPACERS IN A DISPLAY DEVICE

STATEMENT OF GOVERNMENT RIGHTS

This invention was made with government support under contract No. DABT63-93-C0025 awarded by Advanced Research Projects Agency (ARPA). The Government has certain rights in this invention.

BACKGROUND OF THE INVENTION

The present invention relates to displays, and more particularly to processes for creating spacer attachment sites for a field emission display (FED).

Referring to FIG. 1, in a typical FED (a type of flat panel display), a backplate (cathode) 21 has a substrate 10, such as glass, on which conductive layers 12, such as doped polycrystalline silicon or aluminum, are formed. Conical emitters 13 are formed on conductive layers 12. A dielectric layer 14 surrounds emitters 13, and a conductive extraction grid 15 is formed over dielectric layer 14. When a voltage differential from a power source 20 is applied between conductive layers 12 and grid 15, electrons 17 bombard pixels 22 of a phosphor coated faceplate (anode) 24. Faceplate 24 has a transparent dielectric layer 16, preferably glass, a transparent conductive layer 26, preferably indium tin oxide (ITO), a black matrix grille (not shown) formed over conductive layer 26 to define regions, and phosphor coating over the regions defined by the grille.

Backplate 21 and faceplate 24 are spaced very close together in a vacuum sealed package. In operation, there is a potential difference on the order of 1000 volts between conductive layers 12 and 26. Electrical breakdown must be prevented in the packaged FED, while the spacing between the plates must be maintained at a desired thinness for high image resolution.

A small area display, such as one inch (2.5 cm) diagonal, may not require additional supports or spacers between faceplate 24 and backplate 21 because glass substrate 16 in faceplate 24 can support the atmospheric load. For a larger display area, several tons of atmospheric force are exerted on the faceplate, thus making spacers important if the faceplate is to be thin and lightweight.

SUMMARY OF THE INVENTION

The present invention includes methods of making spacers in displays and particularly in field emission displays (FEDs). One method includes steps of mixing frit and photoresist together to form a mixture, applying the mixture to a surface of a portion of a faceplate or backplate, removing portions of the mixture to form adhesion sites at desired locations, and attaching spacers at the adhesion sites. In preferred embodiments, the mixture has about 2% frit and 98% photoresist and is provided on a grille and a transparent conductive layer of a faceplate, and is then removed except over portions of the grille.

With the method of the present invention, precise adhesion sites can be conveniently formed. Other features and advantages will become apparent from the following detailed description, drawings, and claims.

DETAILED DESCRIPTION

According to the present invention, frit (a glass powder) and a compatible photoresist are mixed together to form a mixture. Conventional frits, such as Corning 7572 or 7575, and known positive and negative photoresists, such as OCG SC negative photoresists, can be used. For Corning 7572 or Corning 7575, a resist such as OCG SC100 or a polyvinyl alcohol (PVA) based resist could be used. In an exemplary mixture of Corning 7572 and OCG SC100, the mixture is preferably about 1–5% by weight of frit and about 95–99% by weight of resist, and more preferably about 2% by weight of frit and about 98% by weight of resist. The resist and frit are mixed with a low shear technique until a substantially homogeneous mixture without bubbles or froth is obtained. For Corning 7572 and an OCG SC negative resist, the combination can be mixed for about 30–60 minutes.

Figure 2:
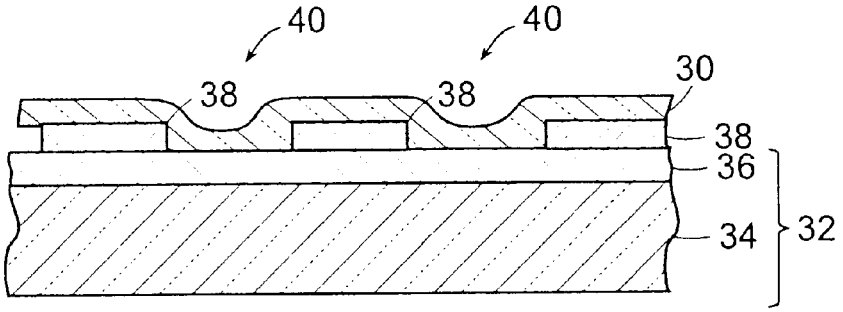
FIG. 2 is a cross-sectional view of a faceplate covered with a layer of frit and photoresist.

Referring to FIG. 2, mixture 30 of frit and photoresist is applied with an even thickness to a faceplate 32 by using known techniques, such as spin coating or spraying. Faceplate 32 has a transparent dielectric layer 34, preferably glass, and a transparent conductive layer 36, such as tin oxide or indium tin oxide (ITO), coating dielectric layer 34. Over conductive layer 36 is a patterned grille 38 made of an opaque, non-reflective material, such as cobalt oxide, manganese oxide, or diaqueous graphite (DAG). Grille 38 defines regions 40 where phosphor particles will later be coated. Mixture 30 thus covers grille 38 and regions 40 (which are not covered by grille 38). After applying the mixture to faceplate 32, the assembly of faceplate 32 and mixture 30 is heated (softbaked) to cure the resist. If the mixture uses OCG SC negative resist, the substrate is heated to about 80–100° C. for a period of about 5–20 minutes.

Figure 3:
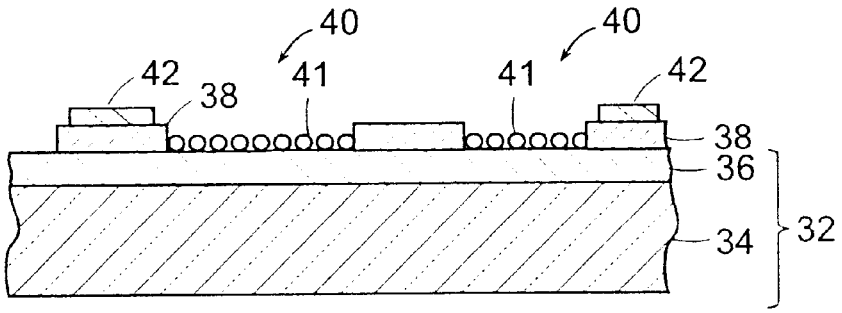
FIG. 3 is a cross-sectional view of the faceplate of FIG. 2 after the layer has been selectively etched and phosphor has been deposited.

Referring to FIG. 3, the resist is then exposed and developed to create desired regions of the mixture of frit and cured photoresist that serve as adhesion sites 42. Exposure is performed according to known techniques, such as using an aligner to align a mask with the assembly and then exposing the masked assembly with known methods, such as projection lithography or contact printing. E-beam lithography could also be used. After exposure, the mixture is developed using an appropriate developing solvent, such as WNRD. The mixture can be developed with a dip-develop technique or a spray-develop technique. For the dip-develop technique, faceplate 32 with mixture 30 is immersed in developer for about two minutes with gentle agitation, and is then removed and put into a second tank with a rinse for about 30 seconds. It is then removed from the second tank and allowed to air dry, or it can be dried with forced gases and/or gentle heat. The developing and rinse times can vary depending on the thickness of the mixture, the softbake process, and other parameters. The developing typically takes about 1.5 to 3 minutes, and the rinse lasts for about 30 seconds.

Figure 4:
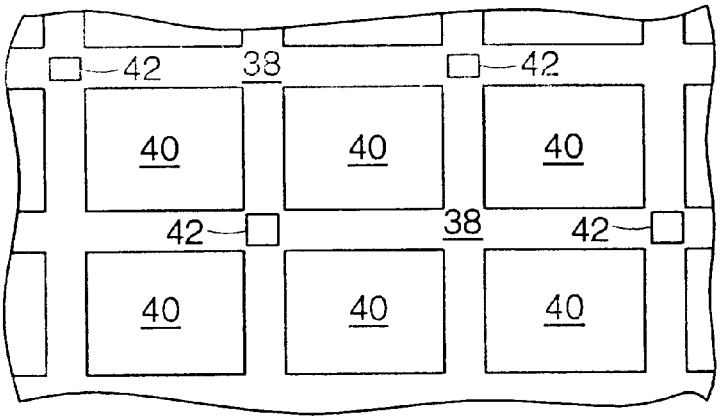
FIG. 4 is a plan view of the faceplate of FIG. 3.

These steps produce a well defined, precise pattern of sites 42 with frit mixed with cured photoresist. The photoresist thus serves to bind the frit to the underlying faceplate. As shown in exemplary FIGS. 3–4, sites 42 are formed at desired alternating intersections of rows and columns of grille 38. The sites could be formed at all intersections or at fewer intersections, or on portions of grille 38 between intersections. The number of adhesion sites with spacers will depend on the strength of the spacers and the size of the display.

After the frit mixed with cured photoresist is formed on the substrate, a glazing step may be performed to help the frit stick together, and to burn off organics in the mixture. This step is typically performed at about 400–450° C., but the temperature could be different depending on the frit used.

Figure 6:
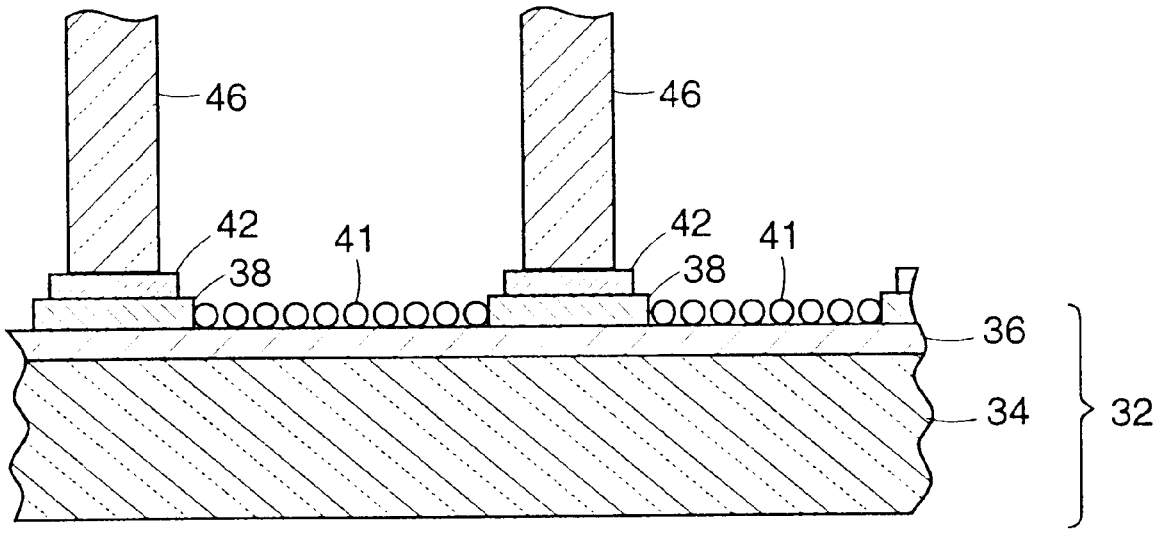
FIG. 6 is a plan view illustrating a bundle of spacers over an adhesion site on a faceplate.
Figure 5:
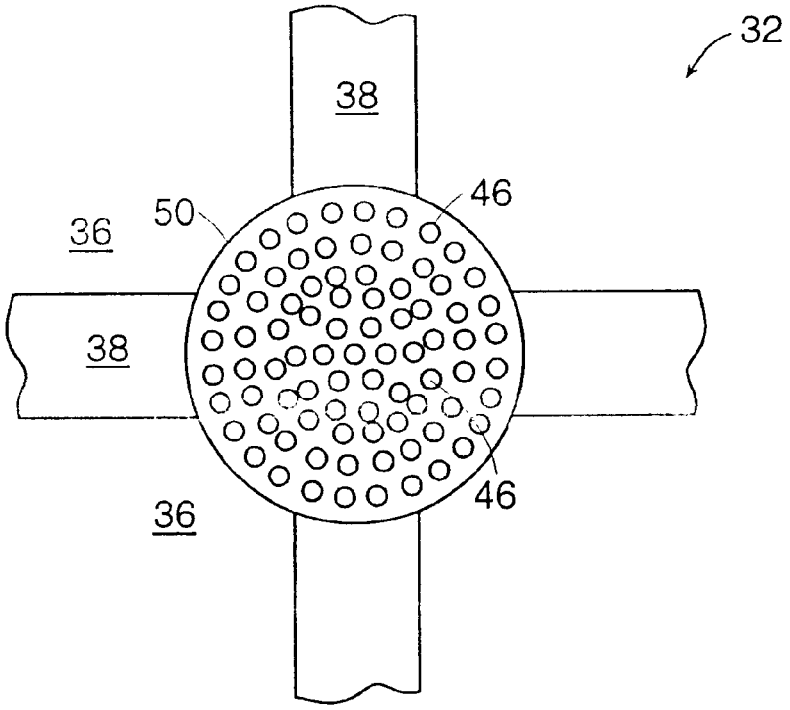
FIG. 5 is a cross-sectional view of the faceplate of FIG. 3 with spacers attached.

Referring to FIGS. 5 and 6, spacers 46 are then attached to faceplate 32 with the frit serving as the adhesive. One way to attach spacers is to provide glass spacers in bundles with binder fibers as described in detail in U.S. Pat. No. 5,486,126, and in application Ser. No. 08/528,761, both of which are expressly incorporated herein by reference for all purposes. Large numbers of spacers 46 are formed in bundles 50 and clamped with uniform pressure to the faceplate at adhesion sites 42 at the intersection of rows and columns of grille 38. Bundles 50 and faceplate 32 are then heated sufficiently to soften the frit. When cooled, some spacers 46 in bundle 50 are firmly attached to grille 38 at sites 42, and thus extend perpendicularly away from the faceplate. The spacers can then be further processed, e.g., with a planarization technique, such as chemical-mechanical planarization (CMP).

Figure 1:
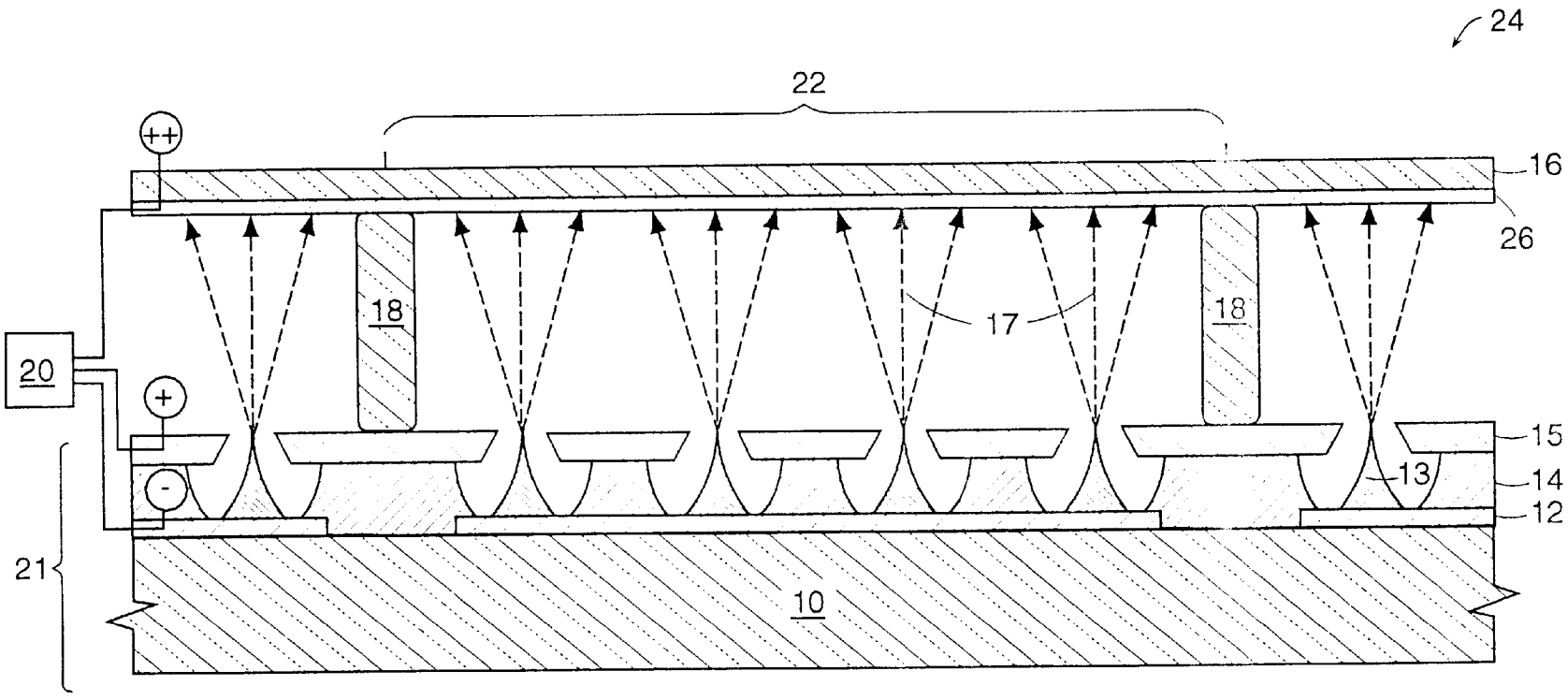
FIG. 1 PRIOR ART
FIG. 1 is a cross-sectional view of a known FED.

The faceplate with spacers is then assembled with the backplate/cathode in a vacuum-sealed package in a generally known manner to produce a display, such as a display similar in principle to that in FIG. 1. The spacers extend to and rest on the extraction grid of the cathode, but preferably are not held there with adhesive; rather, the pressure differential holds the spacers in place.

Having described certain processes according to the present invention, it should be apparent that changes can be made without departing from the scope of the invention as defined by the appended claims. The mixture can also be provided to a backplate, preferably after conductive layers, a silicon layer, an oxide, and a conductive grid layer are formed, and prior to etching to form the emitter cones. The resulting adhesion sites are preferably on the conductive extraction grid. The faceplate need not have a matrix grille, and if it does, spacers can be provided before or after the grille is formed. While a devitreous frit is preferred for the mixture, a vitreous frit can be used.

What is claimed is:

1. A method of making a display having a faceplate and a backplate, the method comprising the steps of:

applying a mixture of frit and photoresist to one of the faceplate and the backplate;

removing portions of the mixture to leave desired locations of the mixture on the one of the faceplate and the backplate;

attaching spacers to the one of the faceplate and the backplate at the desired locations; and assembling together the faceplate and backplate so that the faceplate and backplate are parallel and the spacers extend from the faceplate to the backplate.

2. The method of claim 1, wherein the removing step includes:

exposing the mixture; and developing the mixture to produce a pattern of frit mixed with photoresist.

3. The method of claim 2, further comprising a glazing step after the developing step, the glazing step including heating the mixture.

4. The method of claim 1, wherein the applying step includes a step of applying the mixture over a faceplate having a transparent dielectric layer, a transparent conductive layer over the dielectric layer, and a grille over the conductive layer, the applying step being performed so that the mixture covers the grille and portions of the conductive layer not covered by the grille.

5. The method of claim 1, wherein the attaching step includes applying pressure to a bundle of spacers against the adhesion sites, and heating the spacers and the mixture at the adhesion sites sufficiently to soften the frit.

6. A method of making a field emission display (FED) comprising the steps of:

forming a transparent conductive layer over a transparent dielectric layer;

forming a grille over the conductive layer to define pixel regions;

mixing frit and photoresist together to form a mixture;

providing the mixture over the grille and over the defined regions;

removing portions of the mixture to leave adhesion sites at desired locations on the grille;

attaching spacers to the grille at the adhesion sites; and coating the defined regions with phosphor.

7. The method of claim 6, wherein the removing step includes:

exposing the mixture; and developing the mixture to produce a pattern of frit mixed with photoresist.

8. The method of claim 6, wherein the attaching step includes applying pressure to a number of spacers against the adhesion sites, and heating the spacers and the mixture at the adhesion sites to soften the frit.

9. A method of making a field emission display (FED) comprising the steps of:

forming a transparent conductive layer over a transparent dielectric layer;

forming a grille over the conductive layer to define pixel regions;

providing a mixture of frit and photoresist over the grille and over the defined regions;

exposing the mixture;

developing the mixture to produce a pattern of frit mixed with photoresist at desired adhesion sites on the grille;

attaching spacers to the grille at the adhesion sites by applying pressure to a number of spacers against the adhesion sites and heating the spacers and the mixture at the adhesion sites to soften the frit; and coating the defined pixel regions with phosphor.

10. The method of claim 9, further comprising a step, prior to the providing step, of mixing together the frit and photoresist.

11. The method of claim 10, further comprising a step, after the providing step and before the developing step, of softbaking the mixture to cure the mixture.

12. The method of claim 11, wherein the developing step includes providing the faceplate with the mixture in a developing solvent, and thereafter rinsing the faceplate with the mixture at the desired adhesion sites.

13. The method of claim 9, wherein the developing step includes providing the faceplate with the mixture in a developing solvent, and thereafter rinsing the faceplate with the mixture at the desired adhesion sites.

14. An apparatus comprising:

a transparent dielectric substrate;

a transparent conductive layer over the substrate;

a grille formed in a pattern on the conductive layer to define uncovered regions; and a mixture including frit mixed with photoresist covering at least portions of the grille and the defined uncovered regions.

15. The apparatus of claim 14, wherein the dielectric substrate is glass, the conductive layer is selected from a group consisting of tin oxide and indium tin oxide, and the grille is selected from a group consisting of cobalt oxide, manganese oxide, and diaqueous graphite.

16. A faceplate for a display comprising:

a transparent dielectric substrate;

a transparent conductive layer over the substrate;

a grille formed over the conductive layer and defining pixel regions where the grille is not formed;

a mixture including frit and photoresist covering portions of the grille and not the pixel regions.

17. The apparatus of claim 16, further comprising a plurality of spacers, each having one end in contact with the mixture.

18. A flat panel display comprising:

a faceplate including having a mixture including frit and photoresist at desired locations;

a cathode disposed in parallel to the faceplate and vacuum sealed to the faceplate to define a narrow gap therebetween; and a plurality of spacers extending from the faceplate to the cathode and extending across the gap, each of the spacers having one end rigidly attached to the faceplate with the mixture at one of the desired locations.

19. The flat panel display of claim 18, wherein the faceplate includes:

a transparent dielectric substrate;

a transparent conductive layer over the substrate;

a grille formed in contact with the conductive layer and defining pixel regions where the grille is not formed; and phosphor particles on the conductive layer at the defined pixel regions;

the mixture being formed at desired locations on the grille.

* * * * *